United States Patent [19]

Alexander

[11] 4,091,933

[45] May 30, 1978

[54] HANGING FILE SUPPORT FRAME

[75] Inventor: Robert L. Alexander, Erlanger, Ky.

[73] Assignee: Hunt Manufacturing Co., Philadelphia, Pa.

[21] Appl. No.: 767,577

[22] Filed: Feb. 10, 1977

[51] Int. Cl.[2] ..... B42F 15/00

[52] U.S. Cl. ..... 211/204; 211/46; 312/184; 403/172; 403/176

[58] Field of Search ..... 211/204, 182, 183, 113, 211/184, 162, 189, 46; 312/183, 184; 403/170, 171, 172, 176; 248/221.3, 225.1

[56] References Cited

U.S. PATENT DOCUMENTS

| | | | |
|---|---|---|---|
| 2,336,802 | 12/1943 | Posner | 211/162 |
| 2,810,388 | 10/1957 | Conley | 211/162 |
| 2,852,028 | 9/1958 | Patterson | 211/162 |
| 3,208,456 | 9/1965 | Peebles | 211/181 X |
| 3,356,228 | 12/1967 | Woodhouse | 211/45 |
| 3,734,300 | 5/1973 | Carter | 211/189 |
| 3,853,227 | 12/1974 | Filipowski | 211/184 X |
| 3,860,119 | 1/1975 | Irvine et al. | 211/45 |
| 3,888,355 | 6/1975 | Garrison | 248/221.3 X |

FOREIGN PATENT DOCUMENTS

| | | |
|---|---|---|
| 1,136,114 | 5/1957 | France. |
| 737,226 | 9/1955 | United Kingdom. |
| 1,085,945 | 10/1967 | United Kingdom. |

*Primary Examiner*—James T. McCall
*Assistant Examiner*—Robert W. Gibson, Jr.
*Attorney, Agent, or Firm*—Smith, Harding, Earley & Follmer

[57] ABSTRACT

A hanging file support frame has a pair of channels each having a web portion and opposed hook portions for supporting file folders and has a pair of transverse members. Four corner fittings each have a substantially horizontal opening receiving one end of a transverse member. Each corner fitting also has a bead engaged by one of the hook portions of a channel and an integral resilient latch engaged by the other hook portion of said channel for releasably locking the channels to the fittings. Each corner fitting is supported by a leg. Advantageously, the channels have a plurality of lines of weakness and the corner fittings have opposed grooves for the reception of the hook portions of a channel to support a portion of the channel to be broken off at a line of weakness to adjust the length of the channel.

15 Claims, 10 Drawing Figures

FIG. 1.
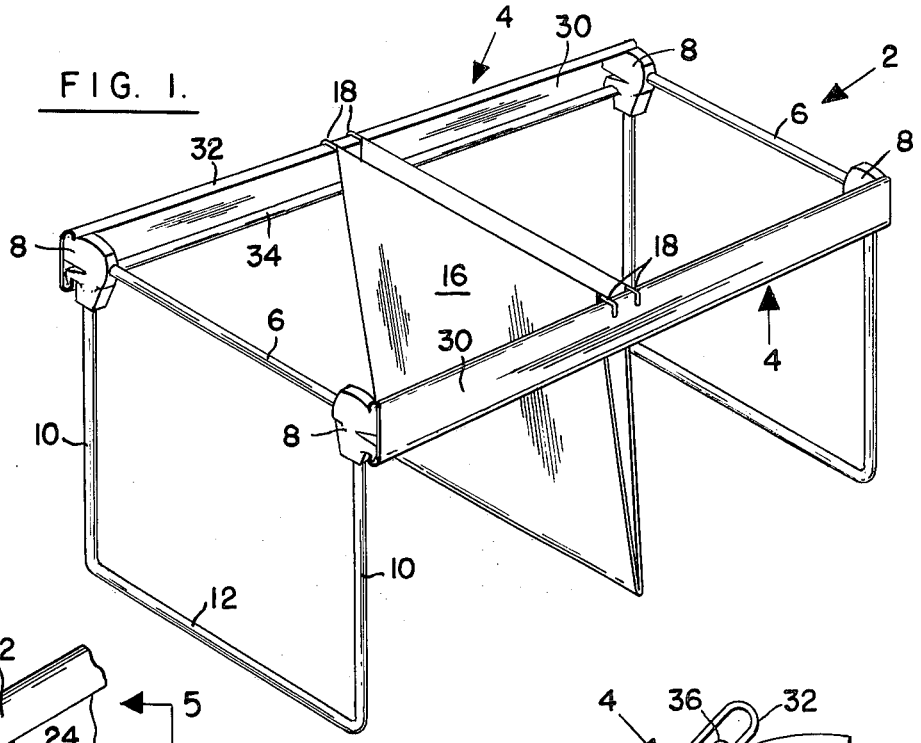
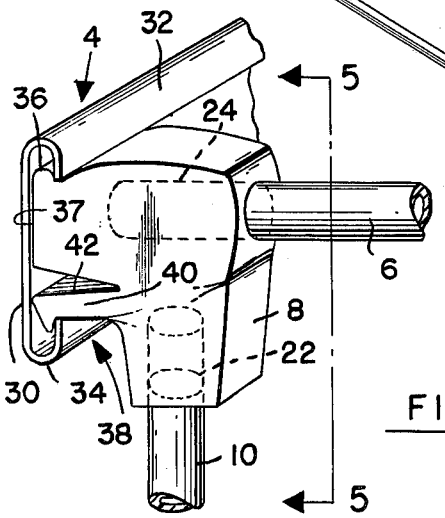
FIG. 2.
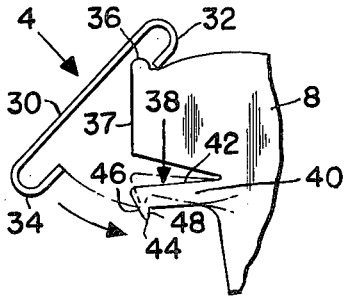
FIG. 3.
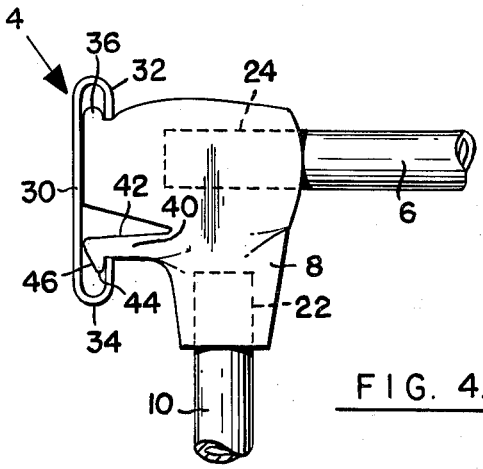
FIG. 4.
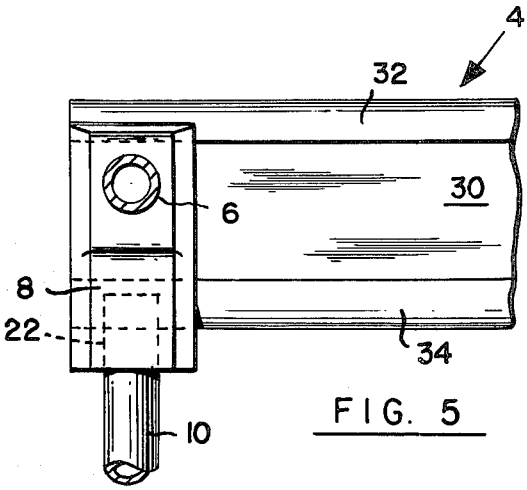
FIG. 5

HANGING FILE SUPPORT FRAME

BACKGROUND OF THE INVENTION

Hanging file support frames are well known to the art as seen for example, in U.S. Pat. Nos. 3,860,119, 3,734,300, 3,356,228, 3,208,456 and 2,852,028 and British Pat. No. 737,226. The structure disclosed in these patents employ a bar for the rail as is also true of applicant's co-pending application Ser. No. 718,561, filed Aug. 30, 1976, the bars in U.S. Pat. No. 3,860,119 having lines of weakness for length adjustment. U.S. Pat. No. 3,208,456 also discloses the use of a channel rail for example a "C" channel supported by looped ends on the top of supporting legs, the looped ends lying inside the channel. French Pat. No. 1,136,114 discloses generally L-shaped channel members for supporting the rails of a hanging file support frame. British Pat. No. 1,085,945 discloses a channel shaped member employed in a rack assembly with the said member being engaged in an opening in an upright member into which it is secured by means of a wedge. Finally, U.S. Pat. No. 2,336,802 discloses the employment of tubular members used as rails for suspending folders.

The invention here provides for the employment of channel members as rails with the attendant advantage of using, for example, sheet metal as distinguished from a solid steel bar employed by much of the prior art as discussed above and, at the same time, provides for the support of the channel members in such a fashion that they are readily secured for assembly and readily removed for disassembly in a unique manner. The resultant structure is easy to assemble and disassemble and provides a substantial cost saving and decreases overall weight. The invention also provides for grooves in the corner fittings to support a channel while breaking off a part of it at a line of weakness to adjust its length.

BRIEF SUMMARY OF THE INVENTION

A hanging file support frame has a pair of channels each having a web portion and opposed hook portions for supporting file folders. Four corner fittings each have a bead engaged by one of the hook portions of a channel and an integral latch engaging the other hook portion of said channel for releasably locking the channels to the fittings. The corner fittings are supported in a spaced relation in an elevated position. Advantageously, the channels have a plurality of lines of weakness and the corner fittings have opposed grooves for the reception of the hook portions of a channel to support a portion of the channel to be broken off at a line of weakness to adjust the length of the channel.

BRIEF DESCRIPTION OF THE DRAWINGS

FIG. 1 is a front perspective view of a hanging file support frame in accordance with the invention;

FIG. 2 is an enlarged perspective view of the left front corner fitting and associated elements of the support frame of FIG. 1, partially broken away;

FIG. 3 is a front elevation of the corner fitting of FIG. 2, partially broken away, and showing its associated channel in the process of being attached thereto;

FIG. 4 is a front elevation of the corner fitting of FIG. 2 and associated parts, partially broken away;

FIG. 5 is a vertical section taken on a plane indicated by the line 5—5 in FIG. 1 and is partially broken away;

DETAILED DESCRIPTION

Figure 6:
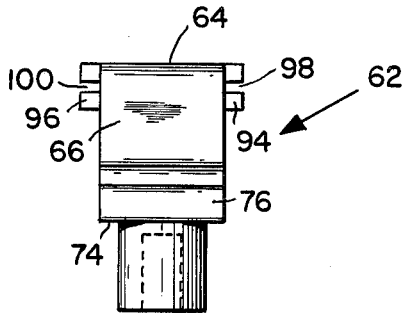
FIG. 6 is a front elevation of an alternative corner fitting in accordance with the invention.
Figure 7:
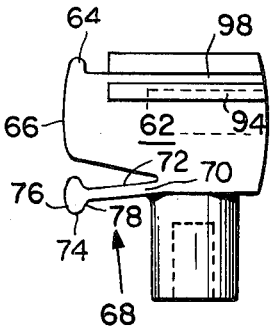
FIG. 7 is a side elevation of the fitting of FIG. 6.
Figure 8:
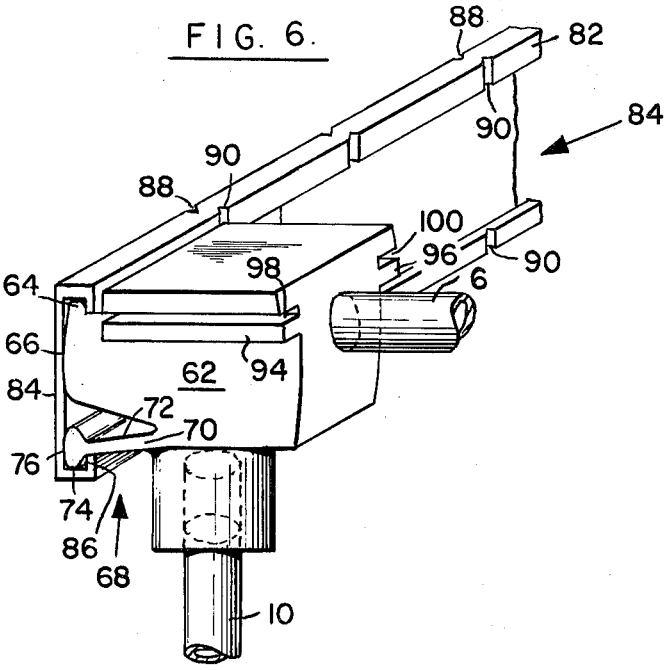
FIG. 8 is a perspective view of the fitting of FIG. 6 with a channel member secured thereto.

As seen in FIG. 1, a hanging file support frame 2 in accordance with the invention has a pair of file folder support channels 4,4 and a pair of tubular transverse members 6,6. Channels 4 and transverse members 6 are supported by four corner fittings 8 each mounted on an upstanding leg 10 of a tubular end support member 12. The channels 4,4 are adapted to support file folders such as the file folders 16 having sliders 18 which are adapted to slide along channels 4,4.

Referring now to FIG. 2, each corner fitting 8 has a bottom opening 22 receiving a leg 10 in a pressed fit and has a side opening 24 for the reception of a transverse member 6 in a pressed fit.

Each channel 4 has a web 30 and opposed hook portions 32 and 34. Each fitting 8 has a bead 36 adjacent the top of outer face 37 (FIG. 3). The interior side of bead 36 is adapted to be engaged by a channel hook portion 32 and an integral resilient latch 38 is adapted to be engaged by a hook portion 34. Latch 38 has a generally horizontal portion 40 the upper face 42 of which is spaced away from the remainder of the fitting 8. Latch 38 has a downwardly extending nose portion 44 (FIG. 3) with an inwardly sloping outer face 46 and an outwardly sloping face 48 to facilitate the upward camming of the latch by hook portion 34 of channel 4 during assembly and disassembly, respectively.

Preferably, the corner fittings 8 are constructed from a strong resilient resin, for example, a polyamide resin such as nylon, or an acetal resin such as DELRIN sold by E. I. Du Pont de Nemours & Co., Inc., Wilmington, Del. Other materials conventionally used to form a support frame can be used. Thus, a metal such as aluminum is satisfactory. The thickness and length of latch 38 will vary depending on the material used in order to have the desired resiliency. The transverse members 6 and the end support members 12 typically will be made of steel or aluminum. The channels 4 typically will be made of aluminum or steel sheet metal.

In assembling the file folder support frame 2, the corner fittings 8 are telescoped over the upper ends of legs 10 of end support members 12. The transverse members are now inserted into the openings 24 of fittings 8. Finally, the hook portion 32 of the channel 4 for one side is placed interior of bead 36 of each of the corner fittings 8 on the same side and then the channel members rotated to bring hook portion 34 into contact with face 46 of latch 38. As channel 30 continues to rotate, latch 38 is cammed upwardly until hook portion 34 passes behind nose 44 at which point the latch springs downwardly to lock this channel 30 to its corner fittings. The opposite channel is secured in the same manner to the other two corner fittings. Disassembly of each channel 30 is accomplished by pulling outwardly on the channel to cam latch 38 upwardly until the hook portion 34 is released beyond nose 44. Both assembly and disassembly is simple and quick and a support frame of good strength is provided at reduced cost.

An alternative corner fitting 62 has a bead 64 adjacent the top of outer face 66. An integral resilient latch 68 has a generally horizontal portion 70 and an upper face 72 which is spaced away from the remainder of the fitting 62. Latch 68 has a downwardly extending nose portion 74 with an inwardly sloping face 76 and an outwardly sloping face 78 for facilitating assembly and disassembly, respectively. The upper hook portion 82 of a channel 84 of, for example, extruded aluminum is retained by bead 64 while the lower hook portion 86 is retained by latch 68. Channel 84 is provided with a plurality of notches 88 in its outer face and notches 90 in the hook portions 82 and 86 opposite the notches 88 to provide for lines of weakness to permit the ready breaking off of a portion of channel 84 to adjust its length.

Figure 10:
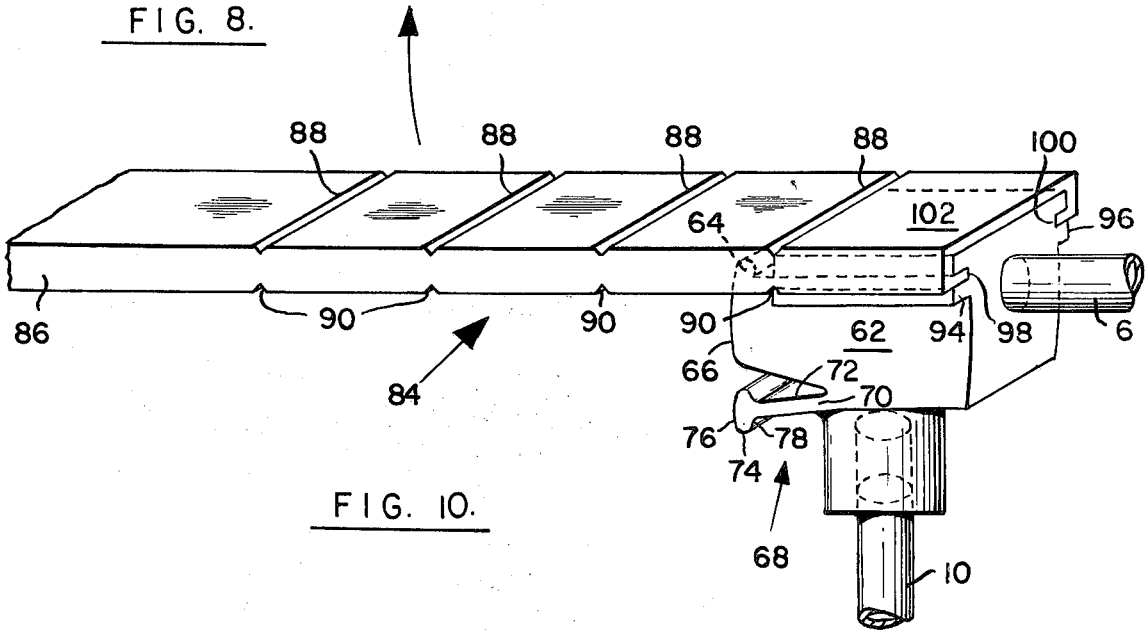
FIG. 10 is a perspective view showing a channel member secured to grooves in the corner member of FIG. 6 preparatory to breaking off a section of the channel member to adjust its length.

Fitting 62 is provided with wing portions 94 and 96 having substantially horizontal grooves 98 and 100, respectively, which extend outwardly beyond the side edges of face 66. As best seen in FIG. 10, grooves 98 and 100 are adapted to receive portions 82 and 86 to provide for a secure mounting of a portion of channel 84 to be broken off. As illustrated in FIG. 10, the end portion 102 of channel 84 which lies beyond the adjacent notch 88 is supported on corner fitting 62. The upward movement of channel 84 will result in the severance of end portion 102 from the remainder of channel 84 in the vertical plane in which notch 88 lies, the severance being facilitated by notches 88 and 90.

Figure 9:
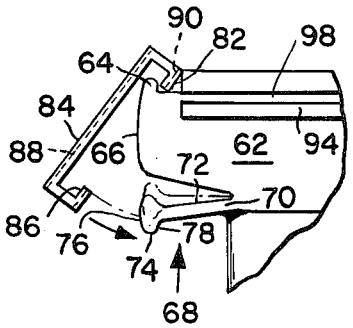
FIG. 9 is a side elevation, partially broken away, showing a channel in the process of being attached to the corner fitting of FIG. 6.

Channel 84 having been adjusted to the desired length as described immediately above, it is now attached to corner fitting 62 and an identical adjacent corner fitting (not shown) by placing hook portion 82 behind bead 64 as illustrated in FIG. 9 and rotating the channel counterclockwise until hook portion 86 snaps in behind the nose 74 of latch 68.

It will be understood that the above-described embodiment is illustrative and is not intended to be limiting.

I claim:

1. A hanging file folder support frame comprising:

a pair of channels for supporting file folders each channel having a web portion and opposed spaced hook portions, four corner fittings each having a bead engaged by one of said channel hook portions and an integral latch below said bead and engaging the other of said channel hook portions for releasably locking the channels to the fittings on rotation of said channels to move the said other channel hook portions into engagement with the latches, and means supporting the corner fittings in a spaced relation in an elevated position.

2. A frame in accordance with claim 1 in which the latch has a top spaced from the remainder of the corner fitting to enhance its resilience.

3. A frame in accordance with claim 1 in which each latch has an outer face sloping inwardly and adapted to be engaged by a channel hook portion to facilitate camming the latch to permit the engagement of the said channel hook portion by the latch.

4. A frame in accordance with claim 3 in which each latch has an inner face sloping outwardly and adapted to be engaged by a channel hook portion to facilitate camming the latch to permit the removal of said channel hook portion from the latch.

5. A frame in accordance with claim 1 in which the channels are of sheet metal.

6. A frame in accordance with claim 1 in which the channels are of extruded aluminum.

7. A frame in accordance with claim 1 in which the supporting means comprises a pair of transverse members each connected to a corner fitting and legs supporting the corner fittings.

8. A frame in accordance with claim 2 in which each latch has an outer inwardly sloping face and an inner outwardly sloping face adapted to be engaged by a channel hook portion to respectively facilitate camming the latch to permit it to engage the said channel hook portion and to facilitate camming the latch to permit the removal of said channel hook portion from the latch.

9. A frame in accordance with claim 8 in which the supporting means comprises a pair of transverse members each connected to a corner fitting and legs supporting the corner fittings.

10. A frame in accordance with claim 9 in which the channels are of sheet metal.

11. A frame in accordance with claim 9 in which the channels are of extruded aluminum.

12. A frame in accordance with claim 1 in which the channels have a plurality of lines of weakness and a corner fitting has opposed grooves for the reception of the hook portions of a channel to support a portion of the channel to be broken off at a line of weakness to adjust the length of the channel.

13. A frame in accordance with claim 2 in which the channels have a plurality of lines of weakness and a corner fitting has opposed grooves for the reception of the hook portions of a channel to support a portion of the channel to be broken off at a line of weakness to adjust the length of the channel.

14. A frame in accordance with claim 11 in which the channels have a plurality of lines of weakness and a corner fitting has opposed grooves for the reception of the hook portions of a channel to support a portion of the channel to be broken off at a line of weakness to adjust the length of the channel.

15. A frame in accordance with claim 12 in which the grooves are substantially horizontal.

* * * * *